US006431163B1

(12) United States Patent
Chipman

(10) Patent No.: US 6,431,163 B1
(45) Date of Patent: Aug. 13, 2002

(54) BASE FOR AN ARCHERY BOW STABILIZER

(75) Inventor: Donald I. Chipman, Clear Lake, IA (US)

(73) Assignee: Specialty Archery Products, Inc., Clear Lake, IA (US)

( * ) Notice: Subject to any disclaimer, the term of this patent is extended or adjusted under 35 U.S.C. 154(b) by 0 days.

(21) Appl. No.: 09/776,966

(22) Filed: Feb. 5, 2001

(51) Int. Cl.[7] ..... F41B 5/20
(52) U.S. Cl. ..... 124/89
(58) Field of Search ..... 124/86, 89

(56) References Cited

U.S. PATENT DOCUMENTS 5,090,396 A * 2/1992 Bickel et al. ..... 124/89
5,558,078 A * 9/1996 Dunlap ..... 124/89
5,611,325 A * 3/1997 Kudlacek ..... 124/89

* cited by examiner

*Primary Examiner*—John A. Ricci
(74) *Attorney, Agent, or Firm*—Gerald E. Helget; Nelson R. Capes; Briggs and Morgan

(57) ABSTRACT

A base for an archery bow stabilizer of the type having a number of parallel, elongate rods, for removably attaching the bow stabilizer to the handle of an archery bow, consisting of a first section having a distal end and a proximal end and having at least one bore therethrough, each bore being adapted to pass one end of one of the parallel, elongate rods therethrough, the rods being received at the distal end and exiting the first section at the proximal end; a second section removably attachable to the first section at the proximal end of the first section and having at least one second bore therethrough, each of the second bores being adapted to receive the end of one of the parallel, elongate rods passed through the first section and also having a removable attachment to the bow handle; and a single connector securing the first section to the second section.

19 Claims, 2 Drawing Sheets

BASE FOR AN ARCHERY BOW STABILIZER

BACKGROUND OF THE INVENTION

The present invention is a base for an archery bow stabilizer of the type having a plurality of elongated stabilizer rods. The base removably secures the stabilizer rods to the handle of an archery bow so that the stabilizer rods extend forwardly of the bow handle in parallel, circumferentially spaced-apart arrangement.

Stabilizers of the type for which the present invention is intended are disclosed in U.S. Pat. No. 5,611,325 (the '325 patent) and U.S. Pat. No. 5,090,036 (the '036 patent).

Each of these patents discloses a base member or end cap for securing the stabilizer rods to the bow handle. However, each of these patents suffers from certain deficiencies.

In each of these patents, the stabilizer rods are secured in apertures in the base member or end cap. In the '036 patent, the rods are secured in the apertures by means of epoxy cement. However, this then requires that the end cap be removed from the bow handle in order to remove the stabilizer, which may be undesirable, particularly in the field.

In the '325 patent, the rods are secured in the apertures or bores by means of set screws, one per rod. This requires that each setscrew must be individually tightened to mount the stabilizer to the end cap and loosened in order to remove the stabilizer from the end cap. Again, this is unnecessarily complicated and undesirable in the field.

In addition, these attachment means do not securely hold the rods in the apertures or bores, with the result that vibrations of the bow handle are not optimally transferred to the rods.

There is a need for a base for an archery bow stabilizer that removably secures the rods to the base member with only a single screw, and also provides more secure attachment of the rods to the bores in the base member.

SUMMARY OF THE INVENTION

A base for an archery bow stabilizer of the type having a number of parallel, elongate rods, for removably attaching the bow stabilizer to the handle of an archery bow, comprising:

a) a first section having a distal end and a proximal end and having at least one bore therethrough, each bore being adapted to pass one end of one of the parallel, elongate rods therethrough, the rods being received at the distal end and exiting the first section at the proximal end;

b) a second section removably attachable to the first section at the proximal end of the first section and having at least one second bore therethrough, each of the second bores being adapted to receive the end of one of the parallel, elongate rods passed through the first section and also having a removable attachment to the bow handle; and c) a single connector securing the first section to the second section.

A principal object and advantage of the present invention is that only a single connector is required to attach the stabilizer to the base.

Another principal object and advantage of the present invention is that the resilient members surrounding the rods in the first section of the base deform in contact with bores in the second section of the base, thereby holding the first section to the second section by frictional engagement.

Another principal object and advantage of the present invention is that the resilient members optimize the transmission of vibrations from the bow handle to the stabilizer.

DETAILED DESCRIPTION OF THE PREFERRED EMBODIMENT

Figures 1, 2, 3, 4:
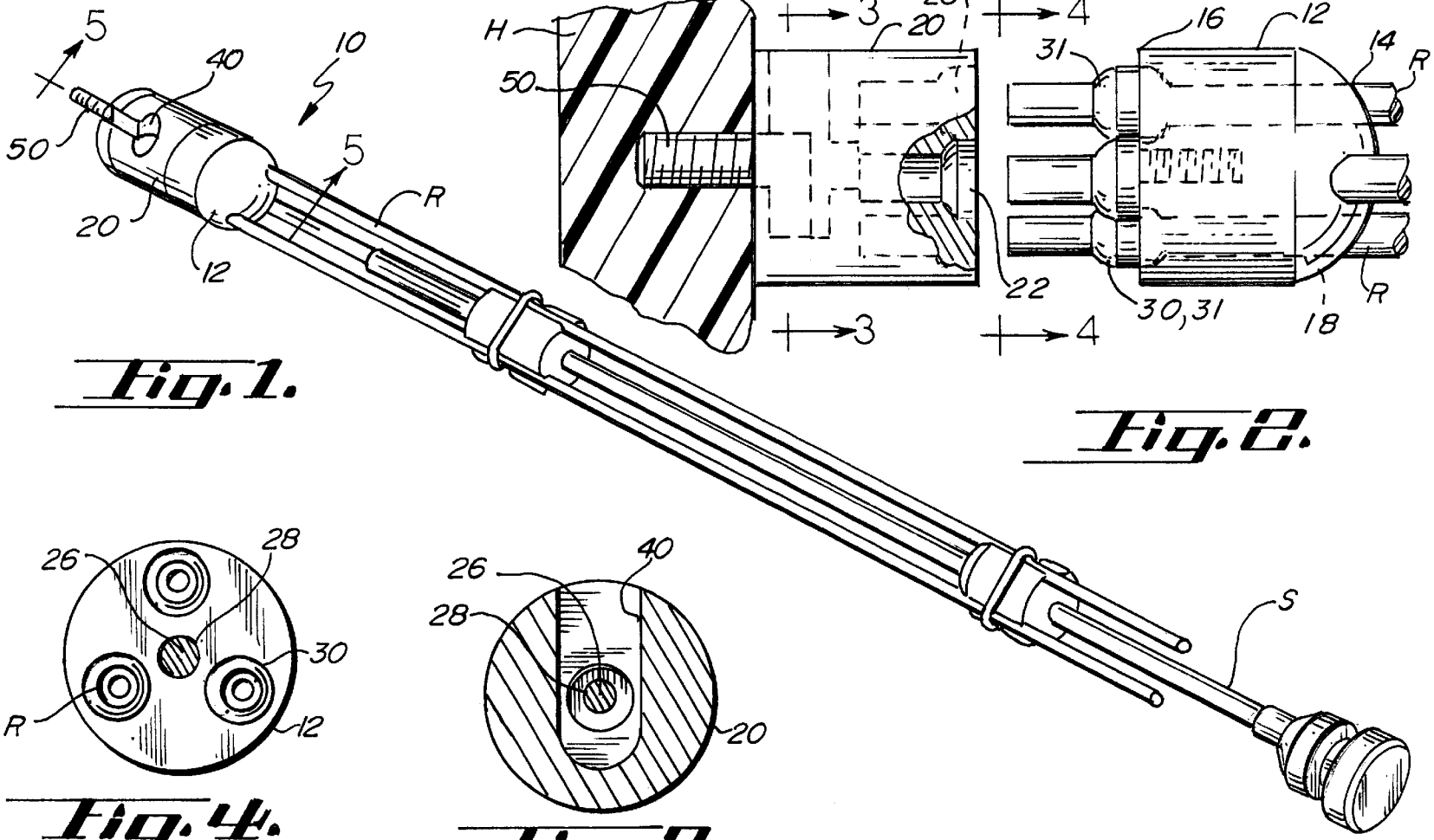
FIG. 1 is a perspective view of an archery bow stabilizer with the base of the present invention attached.
FIG. 2 is an elevational view of the base of the present invention with some structure cut away to show internal details.
FIG. 3 is a cross-section taken approximately at the lines 3 of FIG. 2.
FIG. 4 is a cross-section taken at approximately the lines 4 of FIG. 2.
Figure 5:
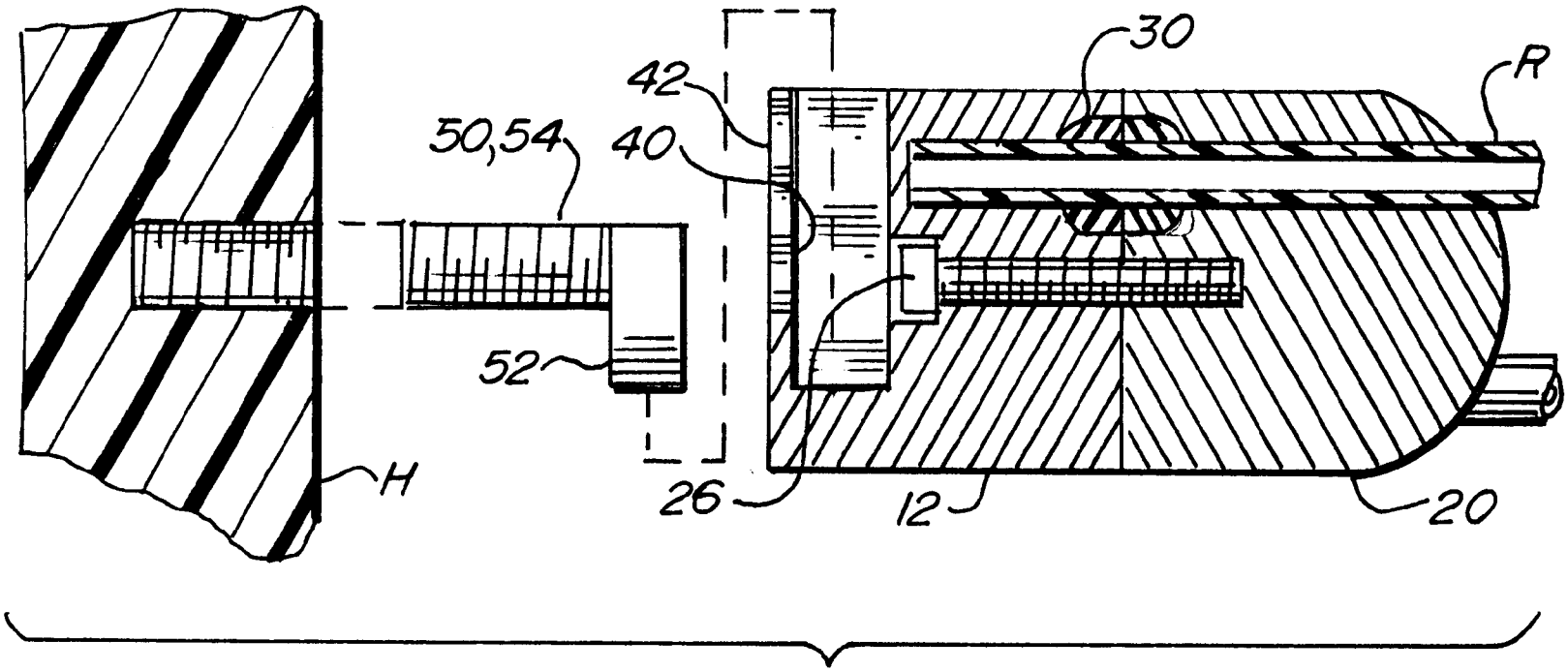
FIG. 5 is a cross-section taken at approximately the lines 5 of FIG. 1.

The bow stabilizer base of the present invention is generally shown in the Figures as reference numeral 10.

As seen in FIG. 1, the base 10 is used with a stabilizer S of the type having elongate parallel rods R.

The base 10 comprises a first section 12 having a distal end 14 and a proximal end 16. The words "distal" and "proximal" refer to the orientation of the base 10 relative to the bow handle H.

The base 10 has at least one first bore 18 therethrough. The first bore 18 is adapted to pass one end of the parallel, elongate rod R therethrough. The rod R is received at the distal end 14 and exits the first section 12 at the proximal end 16.

A second section 20 is removably attachable to the first section 12 at the proximal end 16.

The second section 20 has at least one second bore 22. The second bore 22 is adapted to receive the end of the parallel, elongate rod R that was passed through the first section 12.

The second section 20 also has a removable attachment 50 to the bow handle H.

A single connector 26 secures the first section 12 to the second section 20. Only a single connector is needed, because the rods R are frictionally held between the first section and second section, as will be further described.

The base 10 further comprises a resilient member 30 surrounding each rod R at the proximal end 16 of the first section 12. When the first section 12 is joined to the second section 20, the resilient member 30 deforms in contact with the second bore 22, thereby producing frictional engagement between the resilient member 30 and the second bore 22.

Preferably, the resilient member 30 has a first frustroconical section 31 and the second bore 22 has a generally frustroconical portion 23 matching the shape of the resilient member 30. In this manner, the tapered sides of the resilient member allow the resilient member 30 to be inserted into the second bore 22 in the manner of a rubber stopper being inserted into a bottle.

Preferably, the first bore 18 also has a frustroconical portion 19 at the proximal end of the first section, and the resilient member 30 has a second frustroconical section 32 deformably mating with the frustroconical portion 19. In this manner, the tapered sides of the resilient member allow the resilient member 30 to be inserted into the first bore 18 in the manner of a rubber stopper being inserted into a bottle.

Both the first section 12 and the second section 20 have apertures 28 to receive the single connector 26. The apertures 28 are internally threaded. The single connector 26 has external threads engaging the internal threads of the apertures 28 of the first section 12 and second section 20.

The attachment 50 to the bow handle H preferably further comprises an aperture 40 in the second section 20, with a lip 42. A threaded stud 54 engages the lip 42 and also engages the bow handle H.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A base for an archery bow stabilizer of the type having a number of parallel, elongate rods, for removably attaching the bow stabilizer to the handle of an archery bow, comprising:

a) a first section having a distal end and a proximal end and having at least one first bore therethrough, each first bore being adapted to pass one end of one of the parallel, elongate rods therethrough, the rods being received at the distal end and exiting the first section at the proximal end;

b) a second section removably attachable to the first section at the proximal end of the first section and having at least one second bore, each of the second bores being adapted to receive the end of one of the parallel, elongate rods passed through the first section and also having a removable attachment to the bow handle; and c) a single connector securing the first section to the second section.

2. The base of claim 1, further comprising a resilient member surrounding each rod at the proximal end of the first section.

3. The base of claim 2, wherein the resilient member deforms in contact with the at least one second bore, thereby producing frictional engagement between the resilient member and the at least one second bore.

4. The base of claim 3, wherein the resilient member further comprises a first frustroconical section and the at least one second bore has a frustroconical portion matching the shape of first frustroconical section.

5. The base of claim 3, wherein the resilient member deforms in contact with the at least one first bore, thereby producing frictional engagement between the resilient member and the at least one first bore.

6. The base of claim 5, wherein the resilient member further comprises a second frustroconical section and the at least one first bore has a frustroconical portion matching the shape of the second frustroconical section.

7. The base of claim 1, wherein each of the first section and second section is internally threaded and the single connector has external threads engaging the first section and second section.

8. The base of claim 1, wherein the attachment to the bow handle further comprises an aperture in the second section, the aperture having a lip therein, and a threaded stud having a flange engaging the lip and the threaded stud also engaging the bow handle.

9. A base for an archery bow stabilizer of the type having a number of parallel, elongate rods, for removably attaching the bow stabilizer to the handle of an archery bow, comprising:

a) a first section having a distal end and a proximal end and having at least one first bore therethrough, each first bore being adapted to pass one end of one of the parallel, elongate rods therethrough, the rods being received at the distal end and exiting the first section at the proximal end;

b) a second section removably attachable to the first section at the proximal end of the first section and having at least one second bore, each of the second bores being adapted to receive the end of one of the parallel, elongate rods passed through the first section and also having a removable attachment to the bow handle;

c) a resilient member surrounding each rod at the proximal end of the first section wherein the resilient member deforms in contact with at least one second bore, thereby producing frictional engagement between the resilient member and the at least one second bore; and d) a single connector securing the first section to the second section.

10. The base of claim 9, wherein the resilient member further comprises a first frustroconical section and the at least one second bore has a frustroconical portion matching the shape of first frustroconical section.

11. The base of claim 10, wherein the resilient member deforms in contact with the at least one first bore, thereby producing frictional engagement between the resilient member and the at least one first bore.

12. The base of claim 11, wherein the resilient member further comprises a second frustroconical section and the at least one first bore has a frustroconical portion matching the shape of the second frustroconical section.

13. The base of claim 9, wherein each of the first section and second section is internally threaded and the single connector has external threads engaging the first section and second section.

14. The base of claim 9, wherein the attachment to the bow handle further comprises an aperture in the second section, the aperture having a lip therein, and a threaded stud having a flange engaging the lip and the threaded stud also engaging the bow handle.

15. A base for an archery bow stabilizer of the type having a number of parallel, elongate rods, for removably attaching the bow stabilizer to the handle of an archery bow, comprising:

a) a first section having a distal end and a proximal end and having at least one bore therethrough, each bore being adapted to pass one end of one of the parallel, elongate rods therethrough, the rods being received at the distal end and exiting the first section at the proximal end;

b) a second section removably attachable to the first section at the proximal end of the first section and having at least one second bore, each of the second bores being adapted to receive the end of one of the parallel, elongate rods passed through the first section and also having a removable attachment to the bow handle;

c) a resilient member surrounding each rod at the proximal end of the first section wherein the resilient member deforms in contact with at least one second bore, thereby producing frictional engagement between the resilient member and the at least one second bore;

d) a single connector securing the first section to the second section; and e) wherein the attachment to the bow handle further comprises an aperture in the second section, the aperture having a lip therein, and a threaded stud having a flange engaging the lip and the threaded stud also engaging the bow handle.

16. The base of claim 15, wherein the resilient member further comprises a first frustroconical section and the at least one second bore has a frustroconical portion matching the shape of first frustroconical section.

17. The base of claim 16, wherein the resilient member deforms in contact with the at least one first bore, thereby producing frictional engagement between the resilient member and the at least one first bore.

18. The base of claim 17, wherein the resilient member further comprises a second frustroconical section and the at least one first bore has a frustroconical portion matching the shape of the second frustroconical section.

19. The base of claim 15, wherein each of the first section and second section is internally threaded and the single connector has external threads engaging the first section and second section.

* * * * *